US009911529B2

(12) United States Patent
Sasaki

(10) Patent No.: US 9,911,529 B2
(45) Date of Patent: Mar. 6, 2018

(54) ELECTRONIC COMPONENT

(71) Applicant: MURATA MANUFACTURING CO., LTD., Kyoto (JP)

(72) Inventor: Soitsu Sasaki, Kyoto (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 58 days.

(21) Appl. No.: 14/296,239

(22) Filed: Jun. 4, 2014

(65) Prior Publication Data

US 2014/0285306 A1 Sep. 25, 2014

Related U.S. Application Data

(63) Continuation of application No. PCT/JP2012/078369, filed on Nov. 1, 2012.

(30) Foreign Application Priority Data

Jan. 6, 2012 (JP) ..... 2012-001405

(51) Int. Cl.
*H01F 5/00* (2006.01)
*H01F 27/28* (2006.01)
(Continued)

(52) U.S. Cl.
CPC ..... *H01F 27/2804* (2013.01); *H01F 17/0013* (2013.01); *H01F 27/292* (2013.01); *H01F 41/041* (2013.01); *H01F 2027/2809* (2013.01)

(58) Field of Classification Search
CPC ..... H01F 17/0013; H01F 17/0006; H01F 27/2804; H01F 17/0033; H01F 27/29; H01L 23/5227
(Continued)

(56) References Cited

U.S. PATENT DOCUMENTS 6,154,114 A * 11/2000 Takahashi ..... H01F 27/292 336/200
7,327,212 B2 * 2/2008 Sano ..... H01F 27/027 336/192
(Continued)

FOREIGN PATENT DOCUMENTS

CN 101283417 A 10/2008
JP 07-161529 A 6/1995
(Continued)

OTHER PUBLICATIONS

An Office Action; "Notification of Reasons for Rejection," issued by the Japanese Patent Office on Sep. 1, 2015, which corresponds to Japanese Patent Application No. 2013-552392 and is related to U.S. Appl. No. 14/296,239; with English language translation.
(Continued)

*Primary Examiner* — Elvin G Enad
*Assistant Examiner* — Kazi Hossain
(74) *Attorney, Agent, or Firm* — Studebaker & Brackett PC

(57) ABSTRACT

In an electronic component, a multilayer body is formed by a plurality of stacked insulator layers. A coil includes at least one coil conductor layer provided on at least one of the insulator layers. External electrodes are embedded in a lateral surface of the multilayer body which is formed by a series of continuous perimeter edges of the plurality of insulator layers, and includes a plurality of stacked external conductor layers provided on the plurality of insulator layers. The external electrodes have different shapes. The external conductor layers and the first coil conductor, which are provided on the same insulator layer, are simultaneously formed by photolithography or printing.

6 Claims, 14 Drawing Sheets

(51) Int. Cl.

| | |
|---|---|
| ***H01F 27/02*** | (2006.01) |
| ***H01F 27/29*** | (2006.01) |
| ***H01F 17/00*** | (2006.01) |
| ***H01F 41/04*** | (2006.01) |

(58) Field of Classification Search
USPC ..... 336/200, 83, 192, 232
See application file for complete search history.

(56) References Cited

U.S. PATENT DOCUMENTS

2002/0121957 A1* 9/2002 Takashima ..... H01F 27/2804 336/200
2003/0218526 A1* 11/2003 Fan ..... H01F 17/045 336/83
2006/0038651 A1* 2/2006 Mizushima ..... H01F 17/04 336/83
2006/0097835 A1 5/2006 Tomonari et al.
2008/0257488 A1* 10/2008 Yamano ..... H01F 17/0013 156/272.4
2009/0134956 A1* 5/2009 Hadano ..... H01F 17/0013 333/185
2009/0153282 A1* 6/2009 Taoka ..... H01F 17/0013 336/200
2010/0157565 A1* 6/2010 Yoshida ..... H01F 27/292 361/811
2011/0001599 A1* 1/2011 Takenaka ..... H01F 27/292 336/200
2011/0102124 A1* 5/2011 Matsushita ..... H01F 17/0013 336/200
2012/0133472 A1* 5/2012 Nishikawa ..... H01F 17/04 336/200
2012/0227250 A1 9/2012 Yamano
2015/0170834 A1 6/2015 Yamano

FOREIGN PATENT DOCUMENTS

| | | | |
|---|---|---|---|
| JP | 2006-140229 | A | 6/2006 |
| JP | 2007-134555 | A | 5/2007 |
| JP | 2007-305824 | A | 11/2007 |
| JP | 2008-021752 | A | 1/2008 |
| JP | 2010165975 | * | 1/2009 |
| JP | 2010-165975 | A | 7/2010 |
| JP | 2011-071457 | A | 4/2011 |
| JP | 4816971 | B2 | 11/2011 |
| WO | 2007/080680 | A1 | 7/2007 |

OTHER PUBLICATIONS

International Search Report; PCT/JP2012/078369; Feb. 12, 2013.
Written Opinion of the International Searching Authority; PCT/JP2012/078369; Feb. 12, 2013.
An Office Action; "Notification of Reasons for Refusal," issued by the Japanese Patent Office on May 10, 2016, which corresponds to Japanese Patent Application No. 2013-552392 and is related to U.S. Appl. No. 14/296,239; with English language translation.
An Office Action; "Notification of the First Office Action," issued by the Chinese Patent Office dated Dec. 29, 2015, which corresponds to Chinese Patent Application No. 201280065982.1 and is related to U.S. Appl. No. 14/296,239; with English language translation.

* cited by examiner

ELECTRONIC COMPONENT

CROSS REFERENCE TO RELATED APPLICATIONS

This application claims benefit of priority to Japanese Patent Application No. 2012-001405 filed on Jan. 6, 2012, and to International Patent Application No. PCT/JP2012/078369 filed on Nov. 1, 2012, the entire content of each of which is incorporated herein by reference.

TECHNICAL FIELD

Field of the Disclosure

The present disclosure relates to an electronic component and more specifically relates to an electronic component which includes a coil.

BACKGROUND

An example of known conventional disclosures relating to electronic components is an inductor described in WO 2007/080680. The inductor is formed by providing a coil in a multilayer body which is formed by stacking insulator layers. An external electrode is embedded in a lateral surface of the multilayer body and is formed by photolithography simultaneously with formation of the coil. In the inductor described in WO 2007/080680, the external electrode and the coil are formed in the same step. Therefore, the positional relationship between the external electrode and the coil is unlikely to deviate from a predetermined positional relationship.

In a field to which the inductor described in WO 2007/080680 relates, a structure which can be configured to have arbitrary electric characteristics has been demanded.

SUMMARY

Problems to be Solved by the Disclosure

In view of the above, an object of the present disclosure is to provide an electronic component in which the positional relationship between the external electrode and the coil is unlikely to deviate from a predetermined positional relationship while the electronic component has a structure which can be configured to have arbitrary electric characteristics.

Solution to Problems

An electronic component according to the present disclosure includes: a multilayer body having a shape of a rectangular parallelepiped, and including a plurality of stacked insulator layers; a first coil including at least one first coil conductor layer provided on at least one of the plurality of the insulator layers; and first and second external electrodes embedded in a lateral surface of the multilayer body which is formed by a series of continuous perimeter edges of the plurality of insulator layers, the first and second external electrodes including a plurality of stacked external conductor layers, the plurality of stacked external conductor layers being provided to the plurality of insulator layers, wherein the first external electrode and the second external electrode have different shapes, and the external conductor layers and the first coil conductor, which are provided to the same insulator layer, are simultaneously formed by photolithography or printing.

DETAILED DESCRIPTION

Hereinafter, an electronic component according to an embodiment of the present disclosure is described.

Configuration of Electronic Component

Figure 1:
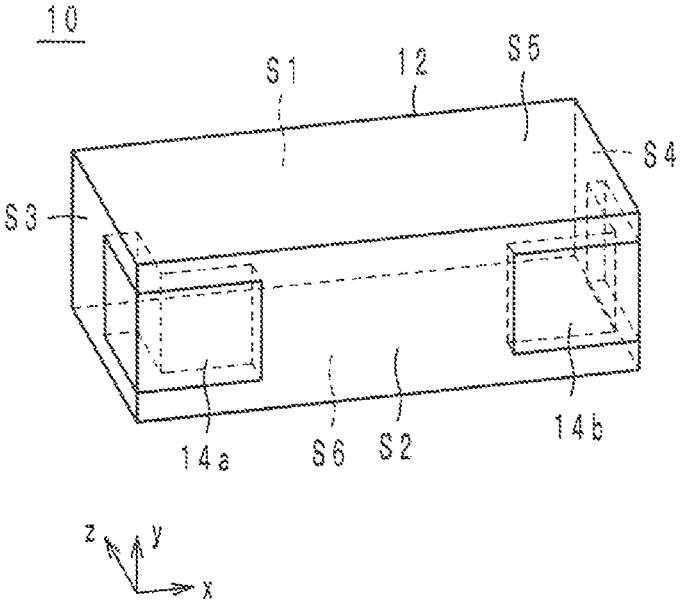
FIG. 1 is a perspective view of the exterior of an electronic component according to one embodiment.
Figure 2:
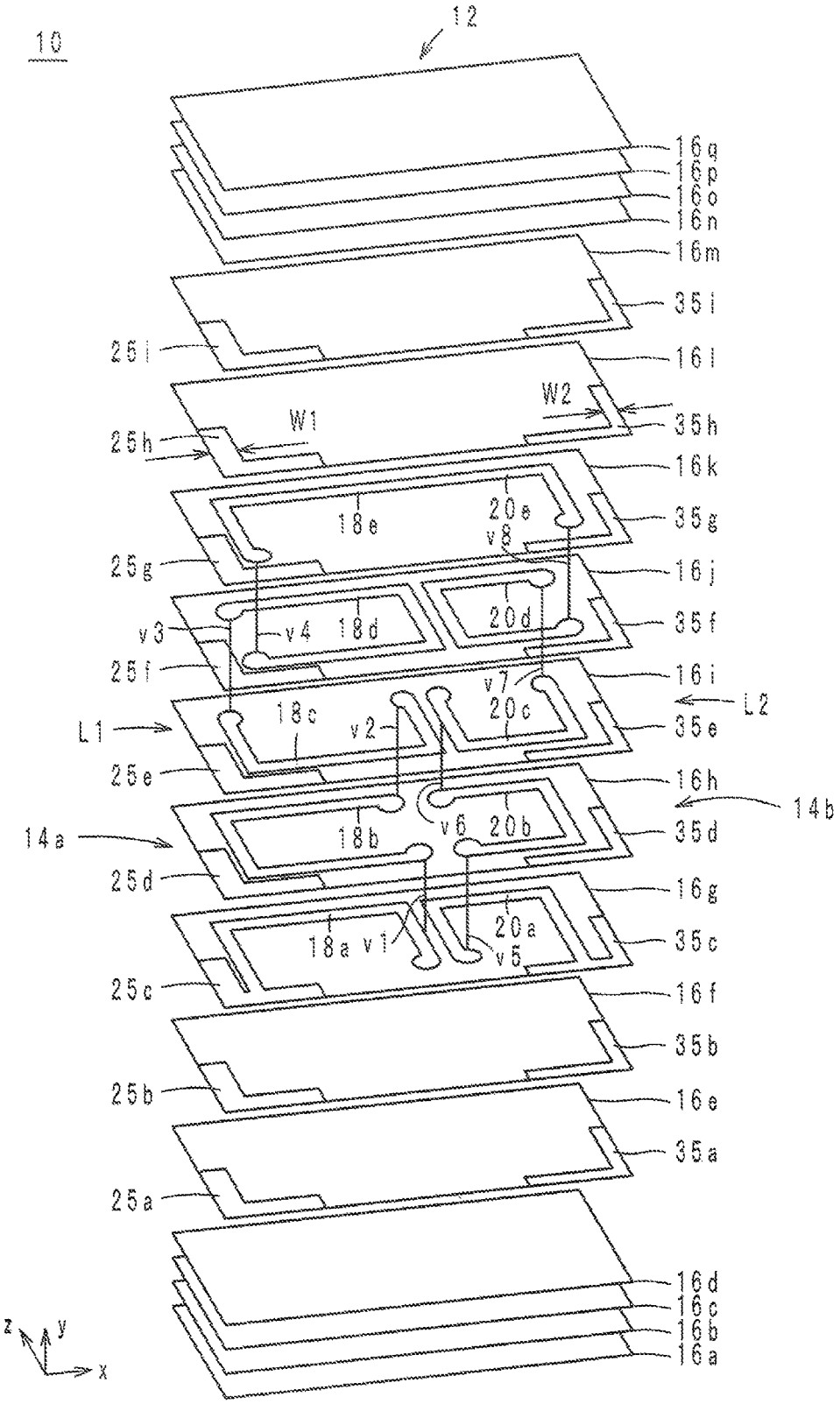
FIG. 2 is an exploded perspective view of the electronic component of FIG. 1.

Hereinafter, the configuration of an electronic component according to one embodiment is described with reference to the drawings. FIG. 1 is a perspective view of the exterior of an electronic component 10 according to one embodiment. FIG. 2 is an exploded perspective view of the electronic component 10 of FIG. 1. In the following description, the layer-stacking direction of the electronic component 10 is defined as the "y-axis direction". When viewed in plan from the y-axis direction, a direction in which the long side of the electronic component 10 is extending is defined as the "x-axis direction", and a direction in which the short side of the electronic component 10 is extending is defined as the "z-axis direction".

As shown in FIG. 1 and FIG. 2, the electronic component 10 includes a multilayer body 12, external electrodes 14 (14*a*, 14*b*), and coils L1, L2 (not shown in FIG. 1).

The multilayer body 12 is formed by a plurality of insulator layers 16 (16*a* to 16*q*) which are stacked so as to be arranged in this order from the negative direction side to the positive direction side of the y-axis direction as shown in FIG. 2. The multilayer body 12 has a shape of a rectangular parallelepiped. Thus, the multilayer body 12 has lateral surfaces S1 to S4, an upper surface S5, and a lower surface S6. The lateral surface S1 is a surface of the multilayer body 12 which is on the positive direction side of the z-axis direction. The lateral surface S2 is a surface of the multilayer body 12 which is on the negative direction side of the z-axis direction. When the electronic component 10 is mounted to a circuit board, the lateral surface S2 serves as a mounting surface which is to face the circuit board. The lateral surface S1 is formed by a series of continuous long sides (i.e., perimeter edges) of the insulator layers 16 which are on the positive direction side of the z-axis direction. The lateral surface S2 is formed by a series of continuous long sides (i.e., perimeter edges) of the insulator layers 16 which are on the negative direction side of the z-axis direction. The lateral surface S3 is a surface of the multilayer body 12 which is on the negative direction side of the x-axis direction. The lateral surface S4 is a surface of the multilayer body 12 which is on the positive direction side of the x-axis direction. The lateral surface S3 is formed by a series of continuous short sides (i.e., perimeter edges) of the insulator layers 16 which are on the negative direction side of the x-axis direction. The lateral surface S4 is formed by a series of continuous short sides (i.e., perimeter edges) of the insulator layers 16 which are on the positive direction side of the x-axis direction. The lateral surfaces S3, S4 are adjacent to the lateral surface S2. The upper surface S5 is a surface of the multilayer body 12 which is on the positive direction side of the y-axis direction. The lower surface S6 is a surface of the multilayer body 12 which is on the negative direction side of the y-axis direction.

The insulator layers 16 have a rectangular shape as shown in FIG. 2 and are made of an insulating material whose main component is borosilicate glass, for example. In the following description, a surface of the insulator layers 16 which is on the positive direction side of the y-axis direction is referred to as "front surface", and a surface of the insulator layers 16 which is on the negative direction side of the y-axis direction is referred to as "rear surface".

The coil L1 is formed by coil conductor layers 18 (18*a* to 18*e*) and via hole conductors v1 to v4. The coil L1 has such a helical shape that it leads from the negative direction side to the positive direction side of the y-axis direction while circling around clockwise when viewed in plan from the positive direction side of the y-axis direction. The coil conductor layers 18*a* to 18*e* are provided on the front surfaces of the insulator layers 16*g* to 16*k* and have a shape of a rectangular annulus from which one side is cut away. The coil conductor layers 18*a* to 18*d* have ¾ turn, and the coil conductor layer 18*e* has ½ turn. The coil conductor layers 18 are made of, for example, an electrically-conductive material whose main component is Ag. In the following description, an end of the coil conductor layer 18 which is on the upstream side when viewed in a clockwise direction is referred to as "upstream end", and the other end of the coil conductor layer 18 which is on the downstream side when viewed in a clockwise direction is referred to as "downstream end".

The via hole conductors v1 to v4 penetrate through the insulator layers 16*h* to 16*k*, respectively, in the y-axis direction. The via hole conductors v1 to v4 are made of, for example, an electrically-conductive material whose main component is Ag. The via hole conductor v1 connects the downstream end of the coil conductor layer 18*a* to the upstream end of the coil conductor layer 18*b*. The via hole conductor v2 connects the downstream end of the coil conductor layer 18*b* to the upstream end of the coil conductor layer 18*c*. The via hole conductor v3 connects the downstream end of the coil conductor layer 18*c* to the upstream end of the coil conductor layer 18*d*. The via hole conductor v4 connects the downstream end of the coil conductor layer 18*d* to the upstream end of the coil conductor layer 18*e*.

The coil L2 is formed by coil conductor layers 20 (20*a* to 20*e*) and via hole conductors v5 to v8. The coil L2 has such a helical shape that it leads from the negative direction side to the positive direction side of the y-axis direction while circling around anticlockwise when viewed in plan from the positive direction side of the y-axis direction. The coil conductor layers 20*a* to 20*e* are provided on the front surfaces of the insulator layers 16*g* to 16*k* and have a shape of a rectangular annulus from which one side is cut away. The coil conductor layers 20*a* to 20*d* have ¾ turn, and the coil conductor layer 20*e* has ½ turn. The coil conductor layers 20 are made of, for example, an electrically-conductive material whose main component is Ag. In the following description, an end of the coil conductor layer 20 which is on the upstream side when viewed in an anticlockwise direction is referred to as "upstream end", and the other end of the coil conductor layer 20 which is on the downstream side when viewed in an anticlockwise direction is referred to as "downstream end".

The via hole conductors v5 to v8 penetrate through the insulator layers 16*h* to 16*k*, respectively, in the y-axis direction. The via hole conductors v5 to v8 are made of, for example, an electrically-conductive material whose main component is Ag. The via hole conductor v5 connects the downstream end of the coil conductor layer 20*a* to the upstream end of the coil conductor layer 20*b*. The via hole conductor v6 connects the downstream end of the coil conductor layer 20*b* to the upstream end of the coil conductor layer 20*c*. The via hole conductor v7 connects the downstream end of the coil conductor layer 20*c* to the upstream end of the coil conductor layer 20*d*. The via hole conductor v8 connects the downstream end of the coil conductor layer 20*d* to the upstream end of the coil conductor layer 20*e*.

The downstream end of the coil conductor layer 18*e* and the downstream end of the coil conductor layer 20*e* are connected to each other. Thus, the coils L1, L2 are connected in series.

As shown in FIG. 1, the external electrode 14*a* is embedded in the lateral surfaces S2, S3 of the multilayer body 12 which are formed by a series of continuous perimeter edges of the insulator layers 16*a* to 16*q*. A portion of the external electrode 14*a* which is exposed to the outside of the multilayer body 12 extends over the lateral surfaces S2, S3. Thus, the external electrode 14*a* is L-shaped when viewed in plan from the y-axis direction. As shown in FIG. 2, the external electrode 14*a* is formed by stacked external conductor layers 25 (25*a* to 25*i*).

The external conductor layers 25 (25*a* to 25*i*) are stacked as shown in FIG. 2 so as to penetrate through the insulator layers 16*e* to 16*m* in the y-axis direction and are electrically coupled together. When viewed in plan from the y-axis direction, the external conductor layers 25*a* to 25*i* are L-shaped and are in contact with the short sides of the insulator layers 16*e* to 16*m* which are on the negative direction side of the x-axis direction and with the long sides of the insulator layers 16*e* to 16*m* which are on the negative direction side of the z-axis direction. The external conductor layer 25*c* is connected to the upstream end of the coil conductor layer 18*a*.

As shown in FIG. 1, the external electrode 14*b* is embedded in the lateral surfaces S2, S4 of the multilayer body 12 which are formed by a series of continuous perimeter edges of the insulator layers 16*a* to 16*q*. A portion of the external electrode 14*b* which is exposed to the outside of the multilayer body 12 extends over the lateral surfaces S2, S4. Thus, the external electrode 14*b* is L-shaped when viewed in plan from the y-axis direction. As shown in FIG. 2, the external electrode 14*b* is formed by stacked external conductor layers 35 (35*a* to 35*i*).

The external conductor layers 35 (35*a* to 35*i*) are stacked as shown in FIG. 2 so as to penetrate through the insulator layers 16*e* to 16*m* in the y-axis direction and are electrically coupled together. When viewed in plan from the y-axis direction, the external conductor layers 35*a* to 35*i* are L-shaped and are in contact with the short sides of the insulator layers 16*e* to 16*m* which are on the positive direction side of the x-axis direction and with the long sides of the insulator layers 16*e* to 16*m* which are on the negative direction side of the z-axis direction. The external conductor layer 35*c* is connected to the downstream end of the coil conductor layer 20*a*.

Portions of the external electrodes 14*a*, 14*b* which are exposed to the outside of the multilayer body 12 are plated with Sn and Ni for anticorrosion purposes.

On both sides of the external electrodes 14*a*, 14*b* in terms of the y-axis direction, the insulator layers 16*a* to 16*d* and 16*n* to 16*q* are stacked. As such, the external electrodes 14*a*, 14*b* are not exposed at the upper surface S5 and the lower surface S6.

Here, the external electrode 14*a* and the external electrode 14*b* have different shapes each other. In the present embodiment, the thickness of the external electrode 14*a* is different from the thickness of the external electrode 14*b*. Specifically, the line width W1 of the L-shaped external conductor layers 25 is greater than the line width W2 of the L-shaped external conductor layers 35. As such, the distance between the external electrode 14*a* and the coil L1 is smaller than the distance between the external electrode 14*b* and the coil L2.

The external conductor layers 25*c* to 25*g* and 35*c* to 35*g*, which are provided on the same insulator layers 16*g* to 16*k* on which the coil conductor layers 18*a* to 18*e* and 20*a* to 20*e* are provided, are formed by photolithography or printing simultaneously with formation of the coil conductor layers 18*a* to 18*e* and 20*a* to 20*e*. The simultaneous formation herein means that, in the case of photolithography, the coil conductor layers 18*a* to 18*e* and 20*a* to 20*e* and the external conductor layers 25*c* to 25*g* and 35*c* to 35*g* are exposed and developed using the same photomasks. In the case of printing, it means that the coil conductor layers 18*a* to 18*e* and 20*a* to 20*e* and the external conductor layers 25*c* to 25*g* and 35*c* to 35*g* are formed using the same screen plates.

Method for Manufacturing Electronic Component

Hereinafter, a method for manufacturing the electronic component 10 according to the present embodiment is described with reference to the drawings. FIG. 3 through FIG. 6 are plan views of the electronic component 10 during manufacture.

Figure 3A:
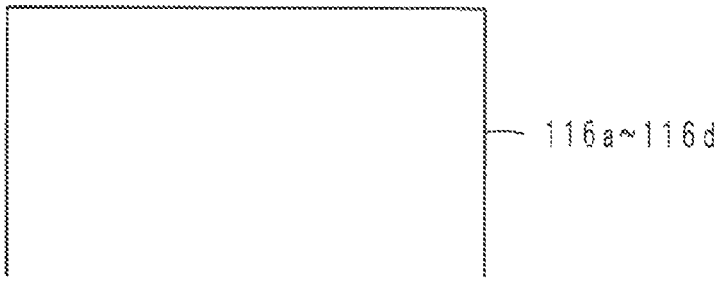
FIGS. 3A to 3D are first to fourth plan views of manufacture of the electronic component, respectively.

Firstly, an insulating paste whose main component is borosilicate glass is repeatedly applied by screen printing to form insulating paste layers 116*a* to 116*d* as shown in FIG. 3A. The insulating paste layers 116*a* to 116*d* are paste layers which are to be the insulator layers 16*a* to 16*d* that are insulator layers for outer layers, which are arranged at outer positions than the coils L.

Figure 3B:
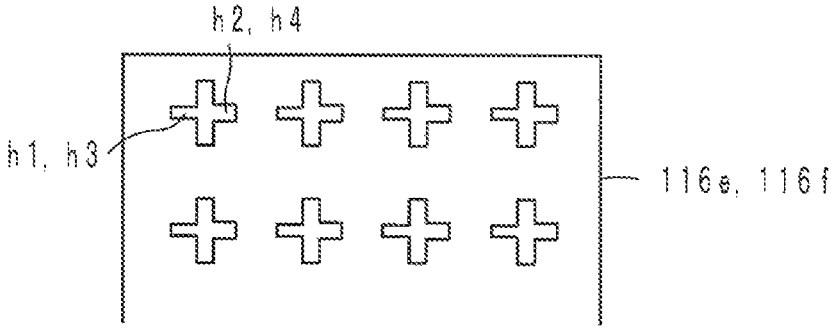

Then, as shown in FIG. 3B, an insulating paste layer 116*e* which has openings h1, h2 is formed by photolithography. Specifically, a photosensitive insulating paste is applied by screen printing to form an insulating paste layer 116*e* on the insulating paste layer 116*d*. Further, the insulating paste layers are irradiated with ultraviolet light or the like via a photomask and are developed using an alkaline solution or the like. The insulating paste layer 116*e* is a paste layer which is to be the insulator layer 16*e*. Each of the openings h1, h2 has a T-shape which is realized by joining two external conductor layers 35*a*, 25*a*. The openings h1, h2 are joined together to have a cruciform shape.

Figure 3C:
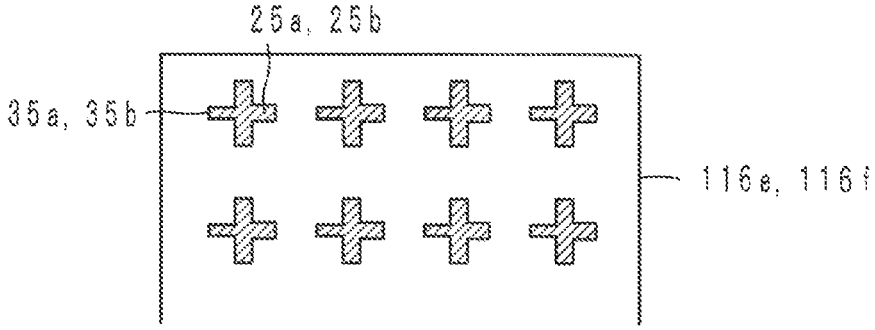

Then, as shown in FIG. 3C, external conductor layers 25*a*, 35*a* are formed by photolithography. Specifically, a photosensitive electrically-conductive paste whose metal main component is Ag is applied by screen printing to form an electrically-conductive paste layer on the insulating paste layer 116*e*. Further, the electrically-conductive paste layer is irradiated with ultraviolet light or the like via a photomask and is developed using an alkaline solution or the like. Thereby, the external conductor layers 35*a*, 25*a* are formed in the openings h1, h2.

Then, as shown in FIG. 3B, an insulating paste layer 116*f* which has openings h3, h4 is formed by photolithography. Specifically, a photosensitive insulating paste is applied by screen printing to form an insulating paste layer 116*f* on the insulating paste layer 116*e*. Further, the insulating paste layer is irradiated with ultraviolet light or the like via a photomask and is developed using an alkaline solution or the like. The insulating paste layer 116*f* is a paste layer which is to be the insulator layer 16*f*. Each of the openings h3, h4 has a T-shape which is realized by joining two external conductor layers 35*b*, 25*b*. The openings h3, h4 are joined together to have a cruciform shape.

Then, as shown in FIG. 3C, external conductor layers 25*b*, 35*b* are formed by photolithography. Specifically, a photosensitive electrically-conductive paste whose metal main component is Ag is applied by screen printing to form an electrically-conductive paste layer on the insulating paste layer 116*f*. Further, the electrically-conductive paste layer is irradiated with ultraviolet light or the like via a photomask and is developed using an alkaline solution or the like. Thereby, the external conductor layers 35*b*, 25*b* are formed in the openings h3, h4.

Figure 3D:
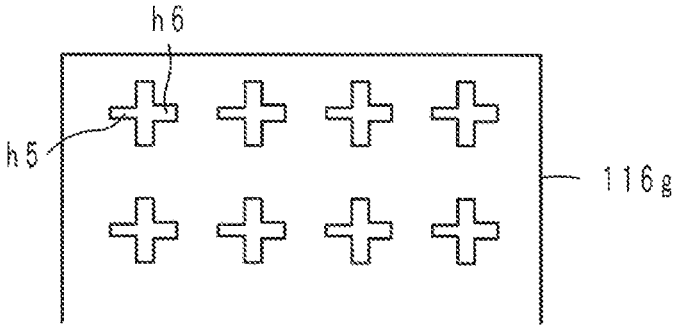

Then, as shown in FIG. 3D, an insulating paste layer 116*g* which has openings h5, h6 is formed by photolithography. Specifically, a photosensitive insulating paste is applied by screen printing to form an insulating paste layer 116*g* on the insulating paste layer 116*f*. Further, the insulating paste layer is irradiated with ultraviolet light or the like via a photomask and is developed using an alkaline solution or the like. The insulating paste layer 116*g* is a paste layer which is to be the insulator layer 16*g*. Each of the openings h5, h6 has a T-shape which is realized by joining two external conductor layers 35*c*, 25*c*. The openings h5, h6 are joined together to have a cruciform shape.

Figure 4A:
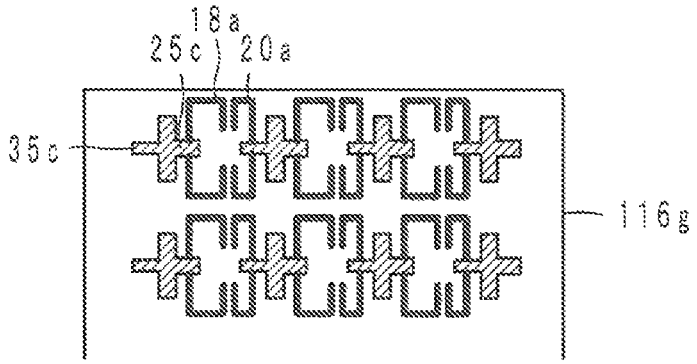
FIGS. 4A to 4D are fifth to eighth plan views in manufacture of the electronic component, respectively.

Then, as shown in FIG. 4A, the coil conductor layers 18*a*, 20*a* and external conductor layers 25*c*, 35*c* are simultaneously formed by photolithography. Specifically, a photosensitive electrically-conductive paste whose metal main component is Ag is applied by screen printing to form an electrically-conductive paste layer on the insulating paste layer 116*g*. Further, the electrically-conductive paste layer is irradiated with ultraviolet light or the like via a photomask and is developed using an alkaline solution or the like. Thereby, the external conductor layers 35*c*, 25*c* are formed in the openings h5, h6, and the coil conductor layers 18*a*, 20*a* are formed on the insulating paste layer 116*g*.

Figure 4B:
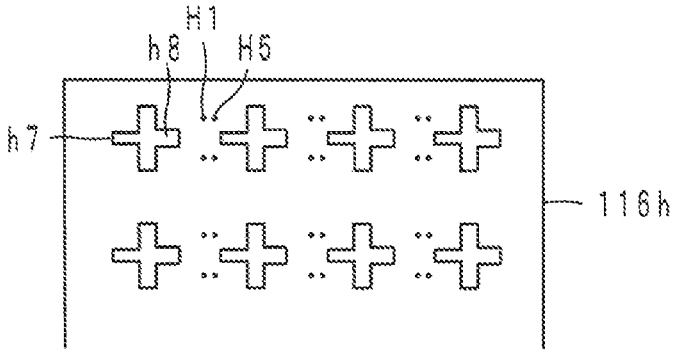

Then, as shown in FIG. 4B, an insulating paste layer 116*h* which has openings h7, h8 and via holes H1, H5 is formed by photolithography. Specifically, a photosensitive insulating paste is applied by screen printing to form an insulating paste layer 116*h* on the insulating paste layer 116*g*. Further, the insulating paste layer is irradiated with ultraviolet light or the like via a photomask and is developed using an alkaline solution or the like. The insulating paste layer 116*h* is a paste layer which is to be the insulator layer 16*h*. Each of the openings h7, h8 has a T-shape which is realized by joining two external conductor layers 35*d*, 25*d*. The openings h7, h8 are joined together to have a cruciform shape.

Figure 4C:
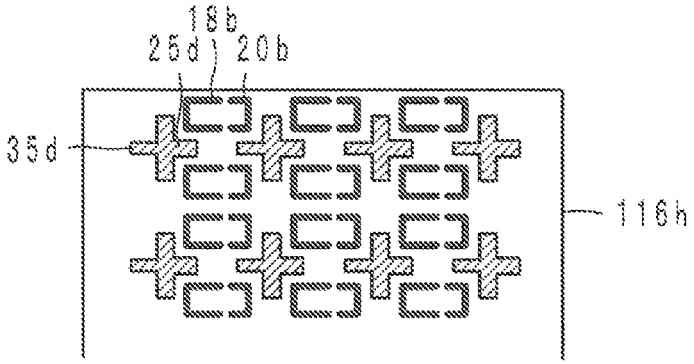

Then, as shown in FIG. 4C, coil conductor layers 18*b*, 20*b*, external conductor layers 25*d*, 35*d*, and via hole conductors v1, v5 are simultaneously formed by photolithography. Specifically, a photosensitive electrically-conductive paste whose metal main component is Ag is applied by screen printing to form an electrically-conductive paste layer on the insulating paste layer 116*h*. Further, the electrically-conductive paste layer is irradiated with ultraviolet light or the like via a photomask and is developed using an alkaline solution or the like. Thereby, the external conductor layers 35*d*, 25*d* are formed in the openings h5, h6, the coil conductor layers 18*b*, 20*b* are formed on the insulating paste layer 116*h*, and the via hole conductors v1, v5 are formed in the via holes H1, H5.

Figure 4D:
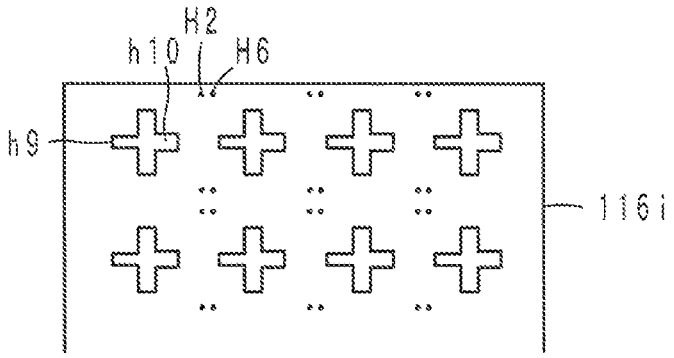

Then, as shown in FIG. 4D, an insulating paste layer 116*i* which has openings h9, h10 and via holes H2, H6 is formed by photolithography. Specifically, a photosensitive insulating paste is applied by screen printing to form an insulating paste layer 116*i* on the insulating paste layer 116*h*. Further, the insulating paste layer is irradiated with ultraviolet light or the like via a photomask and is developed using an alkaline solution or the like. The insulating paste layer 116*i* is a paste layer which is to be the insulator layer 16*i*. Each of the openings h9, h10 has a T-shape which is realized by joining two external conductor layers 35*e*, 25*e*. The openings h9, h10 are joined together to have a cruciform shape.

Figure 5A:
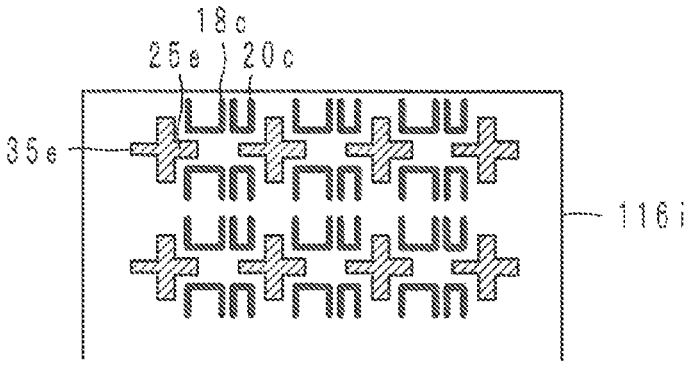
FIGS. 5A to 5D are ninth to twelfth plan views in manufacture of the electronic component, respectively.

Then, as shown in FIG. 5A, coil conductor layers 18*c*, 20*c*, external conductor layers 25*e*, 35*e*, and via hole conductors v2, v6 are simultaneously formed by photolithography. Specifically, a photosensitive electrically-conductive paste whose metal main component is Ag is applied by screen printing to form an electrically-conductive paste layer on the insulating paste layer 116*i*. Further, the electrically-conductive paste layer is irradiated with ultraviolet light or the like via a photomask and is developed using an alkaline solution or the like. Thereby, the external conductor layers 35*e*, 25*e* are formed in the openings h9, h10, the coil conductor layers 18*c*, 20*c* are formed on the insulating paste layer 116*i*, and the via hole conductors v2, v6 are formed in the via holes H2, H6.

Figure 5B:
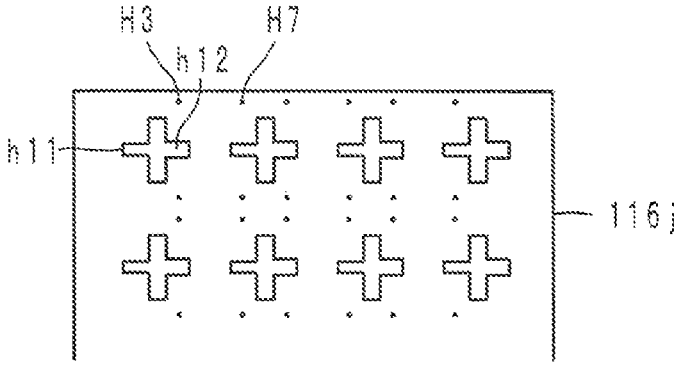

Then, as shown in FIG. 5B, an insulating paste layer 116*j* which has openings h11, h12 and via holes H3, H7 is formed by photolithography. Specifically, a photosensitive insulating paste is applied by screen printing to form an insulating paste layer 116*j* on the insulating paste layer 116*i*. Further, the insulating paste layer is irradiated with ultraviolet light or the like via a photomask and is developed using an alkaline solution or the like. The insulating paste layer 116*j* is a paste layer which is to be the insulator layer 16*j*. Each of the openings h11, h12 has a T-shape which is realized by joining two external conductor layers 35*f*, 25*f*. The openings h11, h12 are joined together to have a cruciform shape.

Figure 5C:
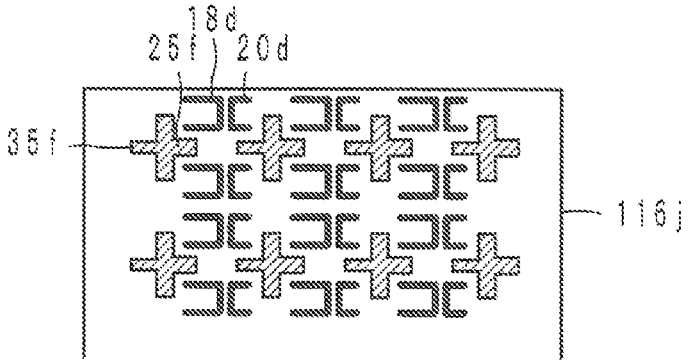

Then, as shown in FIG. 5C, coil conductor layers 18*d*, 20*d*, external conductor layers 25*f*, 35*f*, and via hole conductors v3, v7 are simultaneously formed by photolithography. Specifically, a photosensitive electrically-conductive paste whose metal main component is Ag is applied by screen printing to form an electrically-conductive paste layer on the insulating paste layer 116*j*. Further, the electrically-conductive paste layer is irradiated with ultraviolet light or the like via a photomask and is developed using an alkaline solution or the like. Thereby, the external conductor layers 35*f*, 25*f* are formed in the openings h11, h12, the coil conductor layers 18*d*, 20*d* are formed on the insulating paste layer 116*j*, and the via hole conductors v3, v7 are formed in the via holes H3, H7.

Figure 5D:
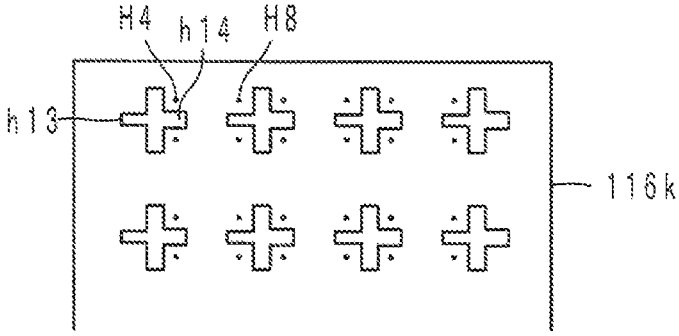

Then, as shown in FIG. 5D, an insulating paste layer 116*k* which has openings h13, h14 and via holes H4, H8 is formed by photolithography. Specifically, a photosensitive insulating paste is applied by screen printing to form an insulating paste layer 116*k* on the insulating paste layer 116*j*. Further, the insulating paste layer is irradiated with ultraviolet light or the like via a photomask and is developed using an alkaline solution or the like. The insulating paste layer 116*k* is a paste layer which is to be the insulator layer 16*k*. Each of the openings h13, h14 has a T-shape which is realized by joining two external conductor layers 35*g*, 25*g*. The openings h13, h14 are joined together to have a cruciform shape.

Figure 6A:
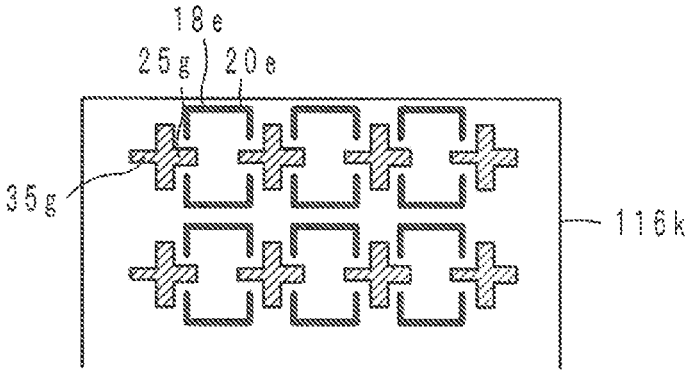
FIGS. 6A to 6D are thirteenth to sixteenth plan views in manufacture of the electronic component, respectively.

Then, as shown in FIG. 6A, coil conductor layers 18*e*, 20*e*, external conductor layers 25*g*, 35*g*, and via hole conductors v4, v8 are simultaneously formed by photolithography. Specifically, a photosensitive electrically-conductive paste whose metal main component is Ag is applied by screen printing to form an electrically-conductive paste layer on the insulating paste layer 116*k*. Further, the electrically-conductive paste layer is irradiated with ultraviolet light or the like via a photomask and is developed using an alkaline solution or the like. Thereby, the external conductor layers 35*g*, 25*g* are formed in the openings h13, h14, the coil conductor layers 18*e*, 20*e* are formed on the insulating paste layer 116*k*, and the via hole conductors v4, v8 are formed in the via holes H4, H8.

Figure 6B:
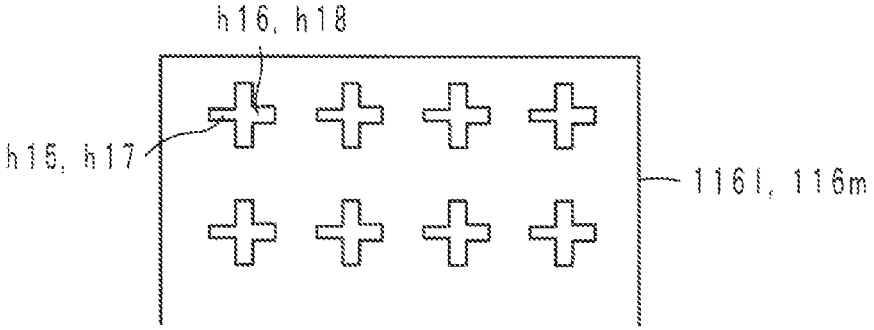

Then, as shown in FIG. 6B, an insulating paste layer 116*l* which has openings h15, h16 is formed by photolithography. Specifically, a photosensitive insulating paste is applied by screen printing to form an insulating paste layer 116*l* on the insulating paste layer 116*k*. Further, the insulating paste layer is irradiated with ultraviolet light or the like via a photomask and is developed using an alkaline solution or the like. The insulating paste layer 116*l* is a paste layer which is to be the insulator layer 16*l*. Each of the openings h15, h16 has a T-shape which is realized by joining two external conductor layers 35*h*, 25*h*. The openings h15, h16 are joined together to have a cruciform shape.

Figure 6C:
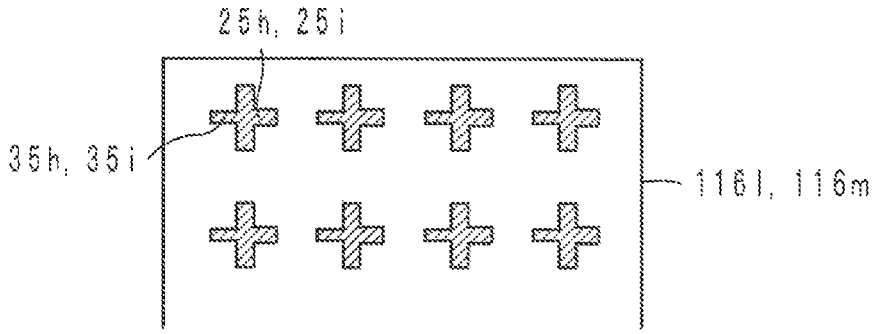

Then, as shown in FIG. 6C, external conductor layers 25*h*, 35*h* are formed by photolithography. Specifically, a photosensitive electrically-conductive paste whose metal main component is Ag is applied by screen printing to form an electrically-conductive paste layer on the insulating paste layer 116*l*. Further, the electrically-conductive paste layer is irradiated with ultraviolet light or the like via a photomask and is developed using an alkaline solution or the like. Thereby, the external conductor layers 35*h*, 25*h* are formed in the openings h15, h16.

Then, as shown in FIG. 6B, an insulating paste layer 116*m* which has openings h17, h18 is formed by photolithography. Specifically, a photosensitive insulating paste is applied by screen printing to form an insulating paste layer 116*m* on the insulating paste layer 116*l*. Further, the insulating paste layer is irradiated with ultraviolet light or the like via a photomask and is developed using an alkaline solution or the like. The insulating paste layer 116*m* is a paste layer which is to be the insulator layer 16*m*. Each of the openings h17, h18 has a T-shape which is realized by joining two external conductor layers 35*i*, 25*i*. The openings h17, h18 are joined together to have a cruciform shape.

Then, as shown in FIG. 6C, external conductor layers 25*i*, 35*i* are formed by photolithography. Specifically, a photosensitive electrically-conductive paste whose metal main component is Ag is applied by screen printing to form an electrically-conductive paste layer on the insulating paste layer 116*m*. Further, the electrically-conductive paste layer is irradiated with ultraviolet light or the like via a photomask and is developed using an alkaline solution or the like. Thereby, the external conductor layers 35*i*, 25*i* are formed in the openings h17, h18.

Figure 6D:
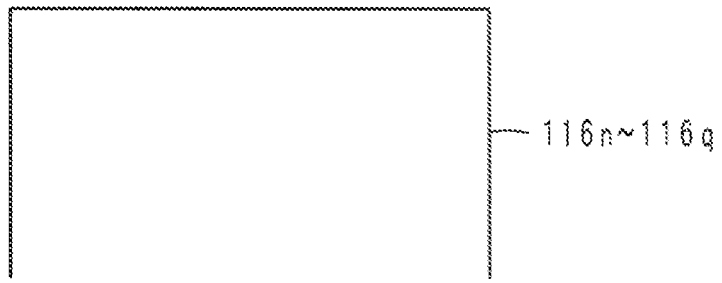

Then, as shown in FIG. 6D, an insulating paste is repeatedly applied by screen printing to form insulating paste layers 116*n* to 116*q*. The insulating paste layers 116*n* to 116*q* are paste layers which are to be the insulator layers 16*n* to 16*q* that are insulator layers for outer layers, which are arranged at outer positions from the coils L. Throughout the above-described process, a mother multilayer body 112 is obtained.

Then, the mother multilayer body 112 is cut into a plurality of un sintered multilayer bodies 12 by dicing or the like. In the step of cutting the mother multilayer body 112, the external electrodes 14*a*, 14*b* are exposed from the multilayer body 12 at cut surfaces which are formed by cutting.

Then, the unsintered multilayer bodies 12 are sintered under predetermined conditions, whereby the multilayer bodies 12 are obtained. Further, the multilayer bodies 12 are subjected to barrel processing.

Lastly, a Ni plating layer which has a thickness of 2 μm to 7 μm and a Sn plating layer which has a thickness of 2 μm to 7 μm are formed over portions in which the external electrodes 14*a*, 14*b* are exposed from the multilayer body 12. Throughout the above-described process, the electronic component 10 is completed.

Effects

According to the electronic component 10 which has the above-described configuration, the positional relationship between the external electrodes 14*a*, 14*b* and the coils L1, L2 is unlikely to deviate from a predetermined positional relationship. More specifically, in the case of an electronic component in which an external electrode is formed in a surface of a multilayer body after formation of the multilayer body that includes a coil, the positional relationship between the external electrode and the coil is likely to deviate from a predetermined positional relationship due to, for example, a variation in the cut position of the multilayer body or a variation in formation of the external electrode.

On the other hand, in the case of the electronic component 10, the external conductor layers 25*c* to 25*g* and 35*c* to 35*g*, which are provided on the same insulator layers 16*g* to 16*k* on which the coil conductor layers 18*a* to 18*e* and 20*a* to 20*e* are provided, are formed by photolithography simultaneously with formation of the coil conductor layers 18*a* to 18*e* and 20*a* to 20*e*. Therefore, the position accuracy of the coil conductor layers 18*a* to 18*e* and 20*a* to 20*e* and the external conductor layers 25*c* to 25*g* and 35*c* to 35*g* depends on the accuracy of photolithography. Thus, in the case of the electronic component 10, the positional relationship between the external electrodes 14*a*, 14*b* and the coils L1, L2 is unlikely to deviate from a predetermined positional relationship as compared with an electronic component in which an external electrode is formed in a surface of a multilayer body after formation of the multilayer body that includes a coil.

Figure 7:
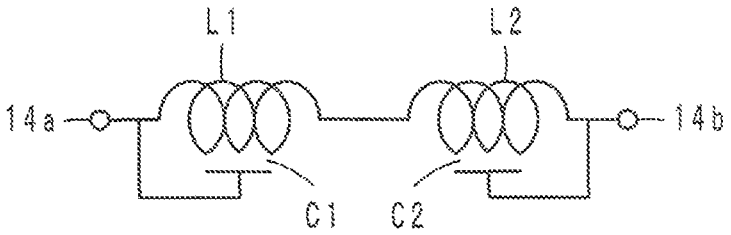
FIG. 7 is an equivalent circuit diagram of the electronic component.
Figure 8:
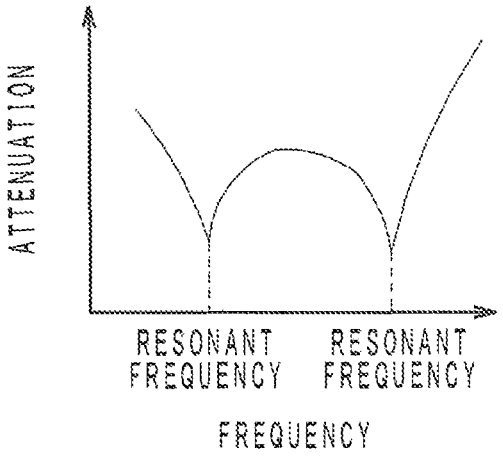
FIG. 8 is a graph showing the relationship between the frequency and the attenuation of the output signal relative to the input signal in the electronic component.

Further, the electronic component 10 can readily have a structure which can be configured to have arbitrary electric characteristics. FIG. 7 is an equivalent circuit diagram of the electronic component 10. FIG. 8 is a graph showing the relationship between the frequency and the attenuation of the output signal relative to the input signal in the electronic component 10. The horizontal axis represents the frequency, and the vertical axis represents the attenuation.

In the electronic component 10, the coils L1, L2 are connected in series between the external electrodes 14*a*, 14*b* as shown in FIG. 7. The external electrodes 14*a*, 14*b* face on the coils L1, L2, respectively, so that capacitors C1, C2 are respectively formed between the external electrodes 14*a*, 14*b* and the coils L1, L2. With this configuration, the electronic component 10 forms a noise filter which has two resonant frequencies shown in FIG. 8.

Here, in the electronic component 10, the external electrode 14*a* and the external electrode 14*b* have different shapes. Therefore, the shape of each of the external electrodes 14*a*, 14*b* can be independently designed, and the capacitors C1, C2 can be formed so as to have arbitrary capacitance values. As a result, the two resonant frequencies shown in FIG. 8 can be changed. In view of the foregoing, the electronic component 10 can have a structure which can be configured to have arbitrary electric characteristics.

First Variation

Figure 9:
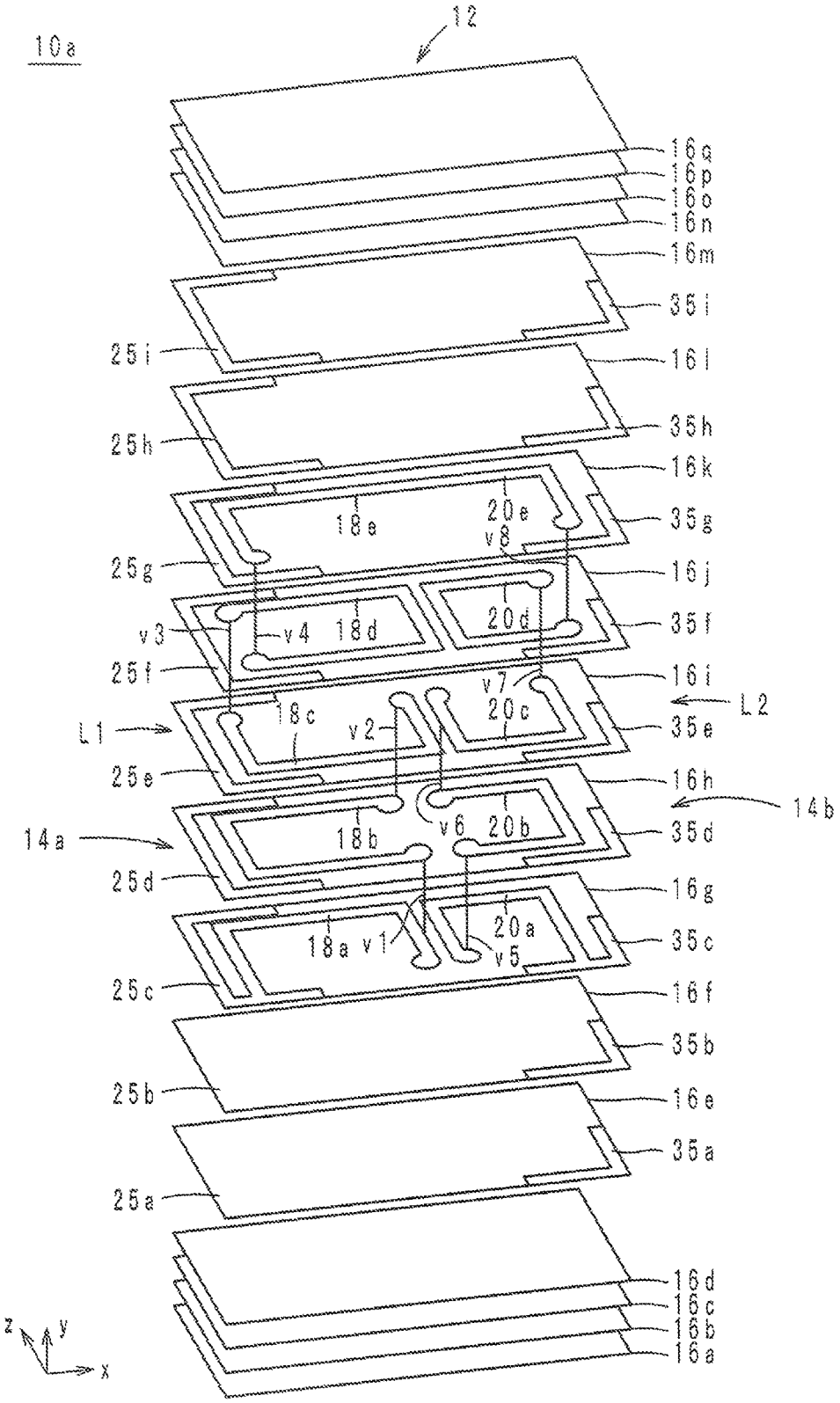
FIG. 9 is an exploded perspective view of an electronic component according to the first variation.

Next, an electronic component 10*a* according to the first variation is described with reference to the drawings. FIG. 9 is an exploded perspective view of the electronic component 10*a* according to the first variation.

The difference between the electronic component 10*a* and the electronic component 10 resides in the shape of the external electrode 14*a*. Specifically, in the electronic component 10, the external electrode 14*a* and the external electrode 14*b* are equal in terms of the shape of a portion of the external electrode 14*a* which is exposed from the multilayer body 12 and the shape of a portion of the external electrode 14*b* which is exposed from the multilayer body 12. However, they have different thicknesses in these portions so that they have different shapes.

On the other hand, in the electronic component 10*a*, the shape of a portion of the external electrode 14*a* which is exposed from the multilayer body 12 and the shape of a portion of the external electrode 14*b* which is exposed from the multilayer body 12 are different so that the external electrodes 14*a*, 14*b* have different shapes. The external electrode 14*a* extends over the lateral surfaces S1, S3, S2 and has an inverted C shape when viewed in plan from the y-axis direction. On the other hand, the external electrode 14*b* extends over the lateral surfaces S2, S4 and has an L shape. In the present embodiment, the thickness of the external electrode 14*a* and the thickness of the external electrode 14*b* are equal. Note that, however, the thickness of the external electrode 14*a* and the thickness of the external electrode 14*b* may be different.

In the electronic component 10*a* which has the above-described configuration, the external electrode 14*a* is provided in the lateral surface S1. The lateral surface S1 is a surface which is on the upper side when the electronic component 10*a* is mounted. Therefore, a portion of the external electrode 14*a* which is provided in the lateral surface S1 can be used as a direction indicator mark. Thus, in the electronic component 10*a*, it is not necessary to form an additional direction indicator mark.

In the electronic component 10*a*, the area of a portion of the external electrode 14*a* which faces on the coil L1 and the area of a portion of the external electrode 14*b* which faces on the coil L2 can be arbitrarily set. Due to this feature, the electronic component 10*a* can have a structure which can be configured to have arbitrary electric characteristics.

Second Variation

Figure 10:
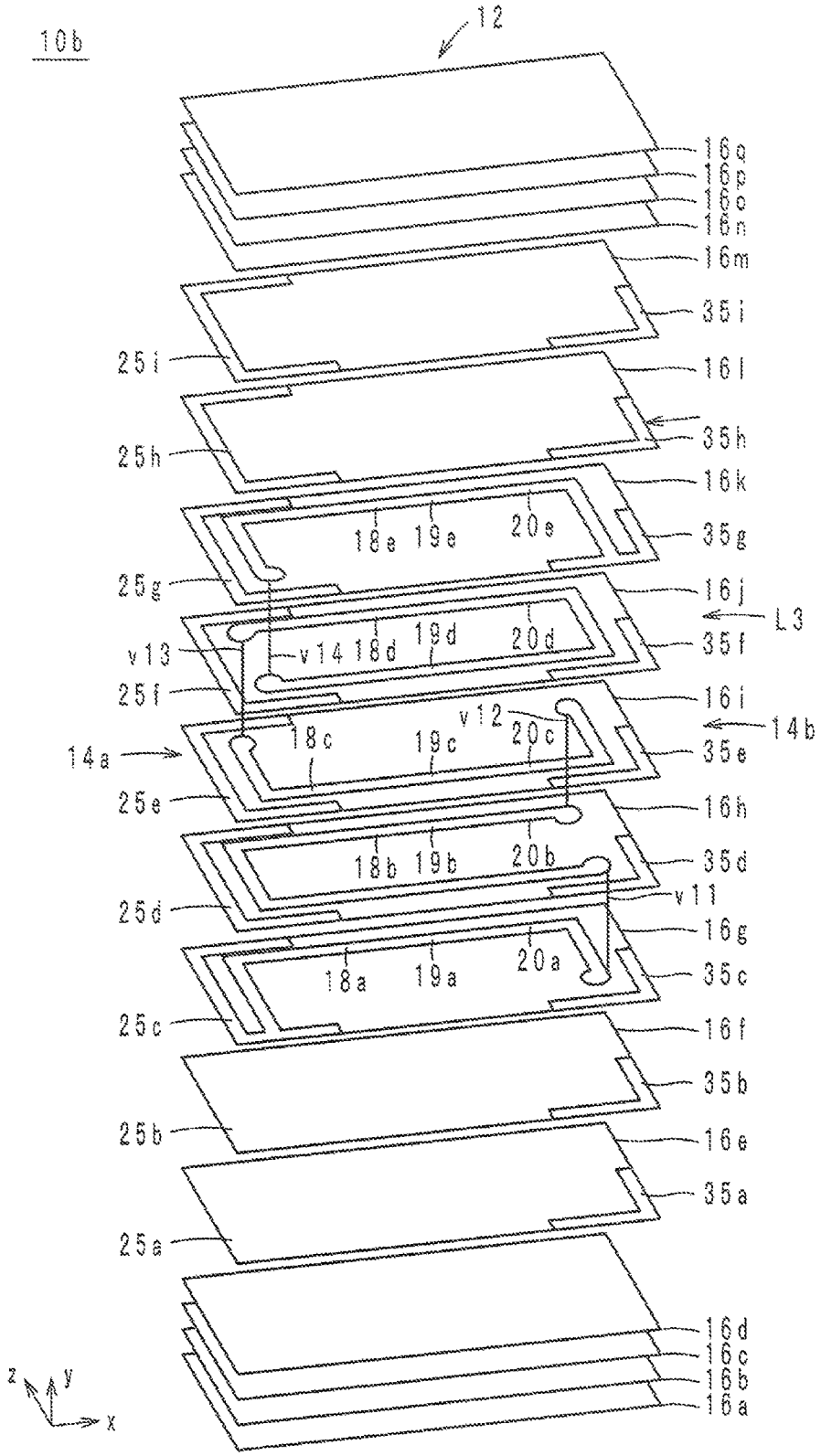
FIG. 10 is an exploded perspective view of an electronic component according to the second variation.

Next, an electronic component 10*b* according to the second variation is described with reference to the drawings. FIG. 10 is an exploded perspective view of the electronic component 10*b* according to the second variation.

The difference between the electronic component 10*b* and the electronic component 10 resides in the number of coils.

Specifically, the electronic component 10 includes the coils L1, L2. On the other hand, the electronic component 10*a* only includes a coil L3. Thus, the number of coils is not limited to two.

Third Variation

Figure 11:
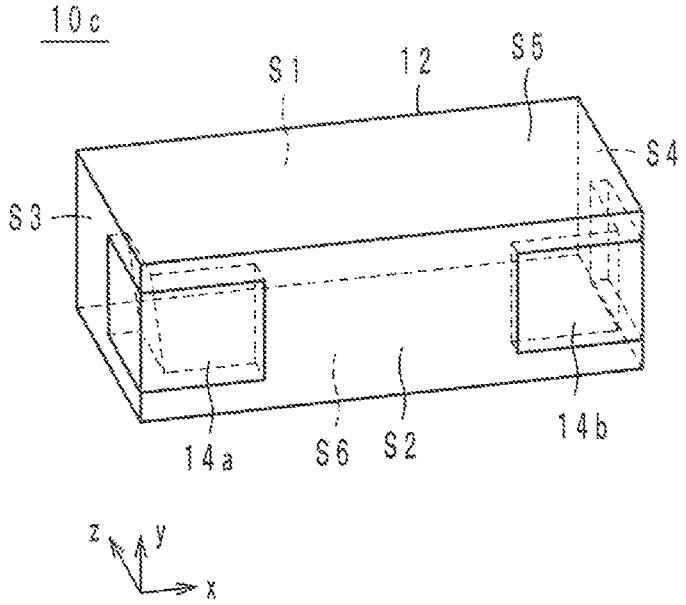
FIG. 11 is a perspective view of the exterior of an electronic component according to the third variation.

Next, an electronic component 10*c* according to the third variation is described with reference to the drawings. FIG. 11 is a perspective view of the exterior of the electronic component 10*c* according to the third variation.

The difference between the electronic component 10*c* and the electronic component 10 resides in the shape of the external electrode 14*a*. More specifically, in the electronic component 10, the external electrode 14*a* has a certain thickness as shown in FIG. 1. On the other hand, in the electronic component 10*c*, the thickness of the external electrode 14*a* decreases toward the positive direction side of the y-axis direction. This varying thickness of the external electrode 14*a* enables the capacitor C1 to have a varying capacitance.

An electronic component according to the present disclosure is not limited to the electronic components 10, 10*a* to 10*c* of the above-described embodiments but can be modified within the scope of the spirit of the disclosure.

In the electronic component 10, the coil conductor layers 18, 20 are to be formed by photolithography but may be formed by printing.

What is claimed is:

1. An electronic component comprising:

a multilayer body having a shape of a rectangular parallelepiped, and including a plurality of stacked insulator layers;

a first coil including two or more first coil conductor layers respectively provided on two or more consecutive insulator layers of the plurality of stacked insulator layers; and first and second external electrodes embedded in a lateral surface of the multilayer body which is formed by a series of continuous perimeter edges of the plurality of stacked insulator layers, each of the first and second external electrodes including a plurality of stacked external conductor layers embedded in the lateral surface of the multilayer body, the plurality of stacked external conductor layers of each of the first and second external electrodes being provided on the plurality of stacked insulator layers, the first and second external electrodes being electrically connected to the first coil, wherein one of the stacked external conductor layers of each of the first and second external electrodes is provided on each of the two or more consecutive insulator layers, and the stacked external conductor layers on each of the two or more consecutive insulator layers have different shapes from each other.

2. The electronic component according to claim 1, further comprising a second coil including at least one second coil conductor layer provided on at least one of the plurality of stacked insulator layers, wherein the stacked external conductor layers and the second coil conductor are photolithographed or printed on the same insulator layer.

3. The electronic component according to claim 1, wherein a thickness of the first external electrode is different from a thickness of the second external electrode.

4. The electronic component according to claim 1, wherein a shape of a portion of the first external electrode which is exposed from the multilayer body is different from a shape of a portion of the second external electrode which is exposed from the multilayer body.

5. The electronic component according to claim 1, wherein the first external electrode extends over three lateral surfaces, and the second external electrode extends over two lateral surfaces.

6. The electronic component according to claim 5, wherein the first external electrode extends over the three lateral surfaces in plan view in a stacking direction of the plurality of stacked insulator layers, and the second external electrode extends over only the two lateral surfaces in plan view in the stacking direction, the first coil having a helical shape around an axis parallel to the stacking direction.

* * * * *